US010994553B2

(12) United States Patent
Ferrari

(10) Patent No.: US 10,994,553 B2
(45) Date of Patent: May 4, 2021

(54) PRINTING APPARATUS AND CORRESPONDING METHOD

(71) Applicant: Jet-Set S.r.l., Rovato (IT)

(72) Inventor: Sergio Ferrari, Rovato (IT)

( * ) Notice: Subject to any disclaimer, the term of this patent is extended or adjusted under 35 U.S.C. 154(b) by 0 days.

(21) Appl. No.: 15/791,247

(22) Filed: Oct. 23, 2017

(65) Prior Publication Data

US 2018/0111383 A1 Apr. 26, 2018

(30) Foreign Application Priority Data

Oct. 26, 2016 (IT) ..... 102016000107827

(51) Int. Cl.

| | |
|---|---|
| ***B41J 2/18*** | (2006.01) |
| ***B41J 2/175*** | (2006.01) |
| ***B41J 29/17*** | (2006.01) |
| ***B41J 2/135*** | (2006.01) |
| *B41J 2/02* | (2006.01) |

(52) U.S. Cl.

CPC ..... *B41J 2/18* (2013.01); *B41J 2/135* (2013.01); *B41J 2/175* (2013.01); *B41J 2/17556* (2013.01); *B41J 2/17566* (2013.01); *B41J 2/17596* (2013.01); *B41J 29/17* (2013.01); *B41J 2002/022* (2013.01)

(58) Field of Classification Search

CPC ..... B41J 2/18; B41J 2/17556; B41J 2/17596
See application file for complete search history.

(56) References Cited

U.S. PATENT DOCUMENTS

| | | | | |
|---|---|---|---|---|
| 8,408,685 | B2 | 4/2013 | Delueg | |
| 2008/0297577 | A1 | 12/2008 | Wouters | |
| 2009/0040249 | A1 | 2/2009 | Wouters | |
| 2009/0179937 | A1 * | 7/2009 | Yamada | B41J 2/04581 347/17 |
| 2010/0039460 | A1 * | 2/2010 | Delueg | B41J 2/1707 347/7 |
| 2010/0073444 | A1 * | 3/2010 | Sato | B41J 2/1753 347/90 |
| 2010/0110155 | A1 * | 5/2010 | Delueg | B41J 2/175 347/93 |
| 2012/0200619 | A1 | 8/2012 | Bibl | |
| 2015/0174897 | A1 * | 6/2015 | Arimoto | B41J 2/175 347/6 |
| 2016/0288523 | A1 * | 10/2016 | Ohtsu | B41J 2/18 |

FOREIGN PATENT DOCUMENTS

| | | | |
|---|---|---|---|
| EP | 2875956 | 5/2015 | |
| EP | 2875956 A1 * | 5/2015 | B41J 2/18 |

* cited by examiner

*Primary Examiner* — Matthew Luu
*Assistant Examiner* — Kendrick X Liu
(74) *Attorney, Agent, or Firm* — Themis Law

(57) ABSTRACT

A printing apparatus on a print support includes a print head to print on said print support a print material; a feed device to feed the print material to the print head; and a recirculating unit to generate a recirculation of the print material through the print head and having a first container of the print material placed upstream of the print head, a second container of the print material placed downstream of the print head, a first recirculating sub-unit to generate a first flow of the print material from the first container to the print head and the second container, and a second recirculating sub-unit to transfer the print material from the second container to the first container, wherein the first and second containers are both maintained under two distinct negative pressures.

7 Claims, 1 Drawing Sheet

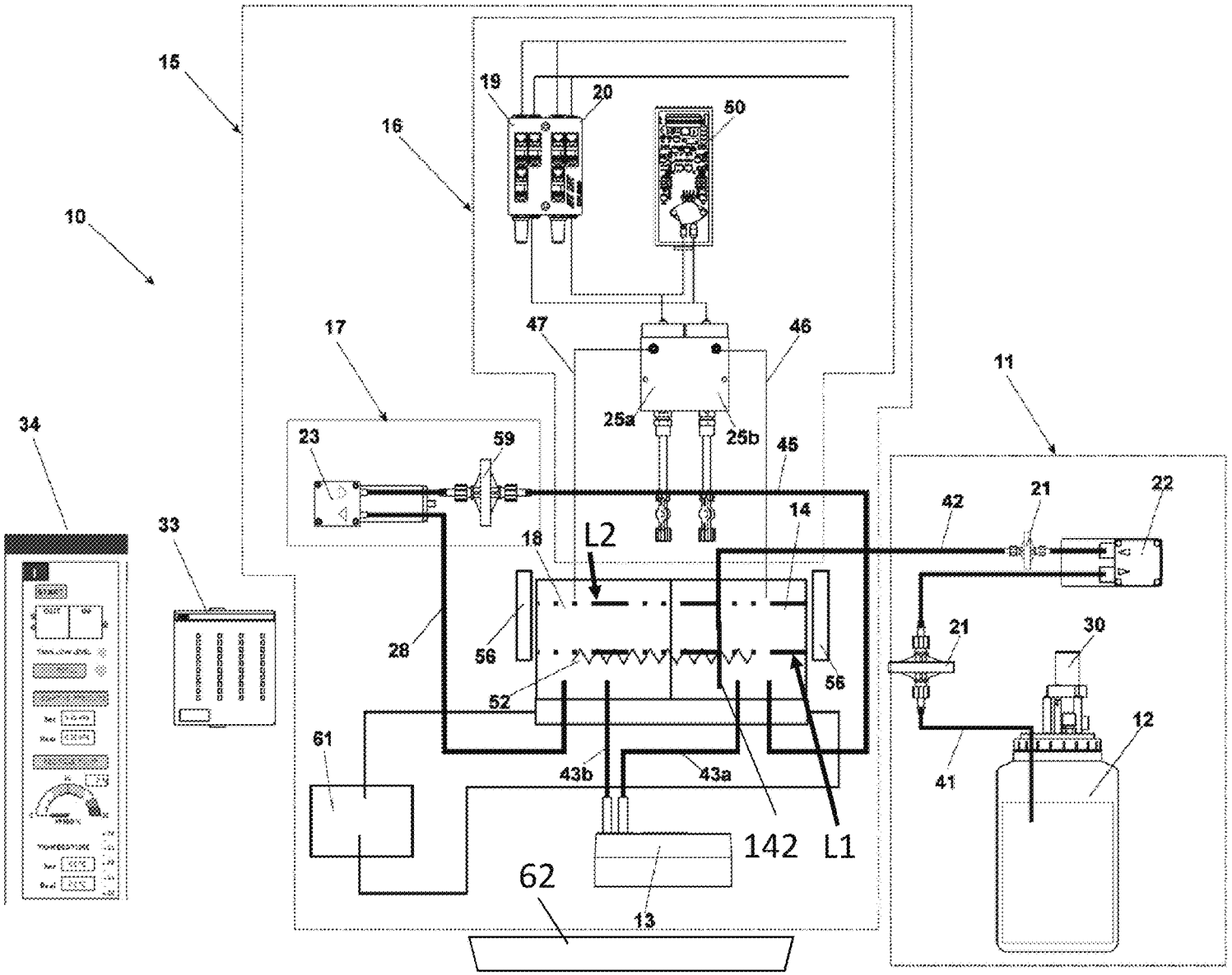
10
11
12
13
14
15
16
17
18
19
20
21
22
23
25a
25b
28
30
33
34
41
42
43a
43b
45
46
47
50
52
56
59
61
62
L1
L2
142

PRINTING APPARATUS AND CORRESPONDING METHOD

FIELD OF THE INVENTION

The present invention relates to a printing apparatus and a method for printing on supports like paper, cardboard, textile materials, metal materials, wood materials, plastic materials, minerals or the like.

BACKGROUND OF THE INVENTION

Printing apparatuses are known that operate according to a so-called ink recirculation system. In this kind of printer, the ink is recirculated between two ink tanks passing through the print head in a channel tangent to the nozzles. The flow of ink along the nozzles generates by a sort of Venturi effect a depression which acts on an ink meniscus which bounds up in the nozzles due to the surface tension of the ink. In its basic configuration, this printer comprises at least a tank for a print material, like a dye, paint, or enhancing materials. In particular, printing apparatuses are known having a plurality of tanks, each dedicated to a distinct color, paint or enhancing material.

The print material, taken from the tank, is channeled to a recirculating unit, which circulates the print material through a print head. In the art, the fact that print material recirculation is necessary is known, primarily for balancing the ink meniscus in order to be maintained inside the nozzle opening and also due to the tendency of sundry print materials to settle and/or sediment, becoming unusable for print, and requiring a downtime for cleaning the printing machine and providing it with new print material.

Application EP2875956A1 by the same applicant describes a printing apparatus comprising a print head for printing a print material on a print support, and a recirculating unit of the print material. The recirculating unit comprises a first container, a second container, a first recirculating device to generate a first stream of said print material from said first container toward said print head and said second container, and a second recirculating device to transfer the print material from the second container to the first container. In particular, the first container of the print material is maintained under atmospheric pressure, while the second container is maintained under negative pressure, i.e. a pressure lower than atmospheric pressure.

Print heads have different requirements in terms of print material flow control; in use, it was shown that not all print heads can be used with the recirculating system described in EP2875956A1. Indeed, particularly for special ink formulations such as ceramic inks or inks comprising heavy particulate components the flow of recirculating ink which passes through the print head needs to be maintained slow in relation to traditional ink recirculation systems. Furthermore, the channel for the ink in the print head has to be maintained negative otherwise the ink will flow out of the nozzles of the print head. As disclosed in EP2875956A1 the recirculation of the ink inside the print head is caused by providing two ink tanks respectively connected to an entrance and to the output of the ink channel in the print head e pressure being applied to the ink in each tank in such a way to generate a pressure difference which drives the ink flow from one tank to the other. In printers in which the print head is displaced at least along one direction in relation to the area to be coated, the speed of the print head is about 1 m/sec, and the ink in the tank is subjected to rapid accelerations and decelerations which causes fluctuations of the pressure in each tank, and thus in the flow rate. This condition further renders the setting of the pressure difference between the two tanks of the recirculation system a particularly critical aspect of the ink recirculation system.

Considering slow recirculation flow ink systems, the need of not applying a positive over pressure in relation to the atmospheric pressure in one of the tanks limits the possibility of setting pressures in the two tanks which allows generating slow flow rates or speeds of ink through the print head. One tank needs indeed not to overcome the atmospheric pressure, so that for setting a pressure difference for obtaining a slow recirculation flow the negative pressure in the other tank will be very close to the atmospheric pressure, rendering the setting more critical. Furthermore, a reduced pressure difference between the two tanks renders the ink pressure and thus the ink flow less stable relatively to the pressure fluctuations introduced by the print head displacement with rapid accelerations and decelerations.

Moreover, it is worthwhile noting that print materials are often emulsions, and a too energetic recirculation can lead to a separation of emulsion phases, in a way conceptually not different from what occurs in the production of butter through cream churning. After using the apparatus described in EP2875956A1 with a plurality of print materials, the applicant noted that in some cases said recirculating unit can lead to an undesired separation of the phases of some print materials.

Documents U.S. Pat. No. 8,408,685, EP1831025 discloses printing apparatus operating according the ink recirculation system. In these documents two tanks or a tank divided into two separate parts is provided which tanks or tank parts are respectively connected to the input and to the output port of an ink flow through channel of the print head. Pressure or depression generating means are provided for applying a depression to one of the tank and a positive pressure to the other tank in order to generate the pressure difference between the two tanks driving the ink to flow from one tank to the other through the print head.

SUMMARY OF THE INVENTION

Aim of the present invention is providing a recirculating unit capable of working with any type of print materials and print head, and of economic construction.

This object is achieved by an apparatus and a method having the features of the independent claims. Advantageous embodiments and refinements are specified in claims dependent thereon.

A recirculating unit according to the present invention comprises:

at least a first container for print material, at least a second container for print material, both maintained under two distinct negative pressures, i.e. a pressure lower than atmospheric pressure.

The fact that both containers are maintained under negative pressure, which can be controlled as desired, allows varying the speed of print material recirculation, working on the quantity of negative pressure applied in order to recirculate print material. This allows building up any kind of pressure difference by controlling actively a pressure in each tank and being completely free from variations of the atmospheric pressure due to environmental causes or to the displacements of the print head. Furthermore, the fact that two negative pressures are applied to the ink avoids that a positive pressure is exercised to the ink and thus breaks the forces maintaining stable the ink meniscus in the nozzles.

The method according to the present invention comprises the following steps:

Supplying a print material through a supply device to a first container making part of the recirculating unit, Generating a first flow of said print material through a first recirculating sub-unit from said first container to said print head and to a second container of the recirculating unit, and Channeling through a second recirculating sub-unit said print material from said second container to said first container, said print material first container and second container being kept under two distinct negative pressures.

According to a further feature which can be provided in combination with the above-mentioned features, the second recirculating sub-unit to transfer the print material from the second container to the first container comprises at least the delivery pipe for feeding the ink into the first container which delivery pipe has an output in the first container which is positioned at a depth inside the said first container below a predetermined minimum level of the ink in the said first container.

According to a variant, the recirculation pipe of the second recirculating sub-unit picking the ink from the second container in order to feed the ink to the first container is provided with an inlet which is placed inside the said second container at a depth below a predetermined minimum level of the ink in the said second container.

The above embodiments allow compensating possible pressure fluctuations introduced by the recirculation pump needed for transferring the ink from the second container back to the first one. This recirculation takes place in a continuous way. The recirculation pump could in some cases introduce a positive pressure which using two negative pressures might at least partially compensate one of the two negative pressures so that the negative pressure acting on the meniscus in the nozzles is changed and potentially reduced in such a way that ink is not anymore retained in the nozzles against dropping out According to a further feature of the present invention which can be provided in any combination with the above embodiments and features an ink feeding device is provided comprising an accumulation tank, a pumping device and an ink refilling pipe for feeding refilling ink to the first print material container, which ink refilling pipe connects the output of pumping device with the first container, a pumping device control unit which drives the pumping device in a pulsed manner, for feeding in an alternate manner predetermined amounts of ink from the accumulation tank to the first container.

According to an embodiment the pumping device driving pulses have a predetermined frequency of the on off cycles of the pumping device with a predetermined repetition frequency and with predetermined time durations of the on and of the off phase of each cycle which are determined according to empirical, particularly experimental ways in relation to the constructive parameters of the print head, of the recirculation unit of the feed device for ink refilling and of the ink kind.

According to an embodiment, the pumping device operate with an on/off cycle of about 100 ms to 1000 ms. In a variant embodiment, the pumping device operates with an on/off cycle in the range from 300 to 700 ms. In a preferred embodiment, the on/off cycle duration of the pumping device is about 500 ms.

According to still a further embodiment the pressure in the circuit is about 8 to 15 kpa.

In an embodiment, the range of the pressure in the second recirculating subunit goes from 0 to 4 Kpa.

According to a further feature which can be provided alternatively or in combination with the preceding features, the ink refilling pipe for feeding refilling ink to the first print material container and connecting the output of pumping device with the first container has an outlet opening which is placed a predetermined depth inside the first container, which depth is lower than a predetermined minimum level of the ink inside the said first container and/or inside the said second container.

The above further improvements relating to the refilling unit allows to ensure that the refilling unit does not introduce perturbations of the negative pressure, particularly in the first container which are detrimental to the pressure conditions for maintaining the meniscus in the correct position inside the nozzle and compromising heavily the functions of the print head. Indeed, in the devices according to the state of the art, operating with an atmospheric pressure exercised on the ink in the first tank, a further pressure difference is introduced by the pumping devices feeding the refilling ink in the first container which would cause a small fluctuation of the pressure in the first tank between a very small negative and a very small positive pressure without sensibility affecting the pressure balance on the meniscus. This condition changes when considering the teaching according to the present invention in which a negative pressure is exercised also on the ink in the first container since the fluctuations could at least in some cases introduce a positive pressure on the ink which can compensate the negative pressure and thus disturb the pressure balance allowing the maintenance of the meniscus in the nozzles of the print head.

A first advantage of the present invention lies in the possibility of using any print head, including print heads that tended to leak print material in undesired way with the previous recirculating system, so leading to a better print quality.

A second advantage of the present invention is a better accuracy of print and the possibility of using any print material, particularly print materials that could not be used in the apparatus according to EP2875956A1.

A third advantage of the present invention is a more accurate control of the print material in the containers supplying print head, improving their control.

BRIEF DESCRIPTION OF THE DRAWINGS

Further advantages and properties of the present invention are disclosed in the following description, in which exemplary embodiments of the present invention are explained in detail based on the drawing:

FIG. 1 is a schematic representation of an embodiment of the present invention.

DETAILED DESCRIPTION OF EMBODIMENTS OF THE INVENTION

FIG. 1 shows an embodiment of a printing apparatus 10 according to the present invention, to print a print material on a (not shown) support.

The print material can comprise an ink, a paint or an enhancing material suitable to confer, for example, a shiny or opaque effect or other graphic effects, such as glitter, sequins or the like, conferred for example by respective paints.

The print support can be made for example of a material chosen from paper, cardboard, textile materials, metal materials, wood materials, plastic materials, mineral materials or ceramic materials, although other types of material can also be used, and are not relevant for the purposes of the present invention.

According to an embodiment, the printing apparatus 10 comprises a feed device 11 to feed the print material toward a recirculating unit 15, which in its turn generates, in a print head 13, a continuous recirculation of the print material. For the sake of convenience, in the description the recirculating unit 15 is subdivided into two recirculating subunits, a first recirculating subunit 16 and a second recirculating subunit 17.

The print head 13 can be selectively controlled, in a substantially known way, to deposit the print material on a (not shown) print support according to a prefixed pattern.

According to a preferred embodiment, the feed device 11 comprises an accumulation tank 12 into which the print material is deposited before printing, and a first pumping device 22 to transfer the print material from the accumulation tank 12 toward the recirculating unit 15.

Said accumulation tank 12 is connected to a filtering device 21 through a pipe 41. The pumping device 22 takes the print material from the accumulation tank 12 through a first suction pipe 41, and channels it to the recirculating unit 15 through a second pipe 42.

In an embodiment, the feed device 11 further comprises a mixing device 30 to periodically or continuously mix the print material contained in the accumulation tank 12.

On the first pipe 41 and/or on the second pipe 42 a filtering device 21 can be interposed, e.g. in the form of a filter or the like.

According to an embodiment a control unit 33 may be provided which drives the pumping device 22 in a pulsed way, such as to feed the ink for refilling the first tank 14 of the recirculation unit 15 with small ink amounts in an alternate manner.

According to a first variant embodiment, the control unit 33 is configured in order to set predetermined repetition frequencies of the on/off deriving cycles of the pumping device 22. Variant embodiments may provide a control unit configured to set the time duration of the on and off phases of the pumping device 22.

According to an embodiment, the control unit 33 is provided with a user interface allowing to input data relating to the repetition frequency and to the duration of the on and off phases of the pumping device 22.

According to still a further embodiment one or more of the above parameters may be set in an automatic way by measuring the level of the ink inside at least the first container 14 by an ink level sensor 56 and by setting at least one of the repetition frequency and to the duration of the on and off phases of the pumping device 22 needed for refilling the ink in the tank in order the level of the ink falls below a minimum level L1.

The algorithm of calculating and setting the above parameters, either manually or automatically is preferably determined in an empirical, especially experimental manner, as a function of the constructive parameters of the system, particularly of the feeding device 11 of the refilling system and of the kind of ink either in house by the system producer or at the system user.

The said algorithm can be in the form of a program in which the instructions are coded for carrying out the algorithm by the control unit 33.

Said recirculating unit comprises a first container 14 for print material connected to the feed device 11. The first container 14 is connected to the accumulation tank 12 through pipe 42. The first container 14 is upstream a respective print head 13 to which is connected through a first pipe 43*a*. In a preferred embodiment, the first pipe 43*a* is connected in correspondence to a lower portion, or bottom, of the first container 14. The connection of the first pipe 43*a* in the lower part of the first container 14 allows preventing the forming of air bubbles in the print material contained in the first container 14.

According to still another feature of the present invention, the second pipe 42 connecting the output of the pumping device with the first container 14 of the recirculating unit 15, has an outlet 142 which is placed at a depth inside the said first container 14 which depth is lower than a predetermined minimum ink level L1 inside the said first container 14.

The recirculating unit further comprises a second container 18 for print material, coming from the print head 13 through pipe 43*b*. In a preferred embodiment, the second pipe 43*b* is connected in correspondence to a lower portion, or bottom, of the second container 18. The connection of the second pipe 43*b* in the lower part of the second container 18 allows preventing the forming of air bubbles in the print material contained in the second container 18.

Print material first container 14 and second container 18 lie on the same plane, and can contain two distinct levels of print material.

The recirculating unit is of pneumatic type and comprises a pair of members 19, 20 (in the form of a series of solenoid valves) for generating negative pressure connected to said print material first container 14 and second container 18. In particular, said members 19, 20 are configured for generating a negative pressure, or depression, inside first container 14 and second container 18. The difference of negative pressure between the first container 14 and the second container 18 leads the print material to shift from the first container 14 to the second container 18, passing through the print head 13.

The members 19, 20 for generating negative pressure comprise a series of solenoid valves assembled on a mechanical block configured to exploit Venturi effect. In particular, the member 19 generates negative pressure in the first container 14, and the member 20 generates negative pressure in the second container 18; the two negative pressures are different between the said print material containers 14 and 18.

Typically, the value of the negative pressure in the print material first container 14 is −4 Kilopascal (kPa), while the value in the print material second container 18 is −10 kPa. This difference in the negative pressures activates the shifting of print material from the first container 14 to the second container 18 passing through the print head 13.

Controlling the two members 19 and 20 for generating negative pressure, the negative pressure in said two print material containers 14 and 18 can be varied. Indicatively, the values of negative pressure which can be obtained range 0 to −50 Kilopascal.

Different print heads and different print materials require the fine-tuning of the negative pressures in print material first container 14 and second container 18.

The detection of negative pressure values is performed by a pressure sensor 50 detecting the negative pressure values in print material containers 14 and 18. The detected values are then transmitted to a control unit 33 controlling the members 19 and 20 so that the desired negative pressure values are obtained.

Moreover, the members 19 and 20 generating negative pressure have a further valve enabling the cleaning of the print head 13 under positive pressure, modifying the pressure inside print material containers 14 and 18. Obviously, cleaning cycles, which implies feeding the print head 13 under positive pressure, are performed when the printing apparatus is not printing.

Moreover, there are provided two overflow tanks 25*a*, 25*b*, which are interposed between print material first container 14 and second container 18, e.g. in an intermediate position between a first connecting pipe 46 and a second connecting pipe 47.

In particular, in the tank 25*a*, connected to the first container 14, air is kept in a condition of negative pressure, and in the tank 25*b*, connected to the second container 18, a condition of negative pressure is generated, too.

Said overflow tanks 25*a* and 25*b* can be provided with (not shown) discharge valves, for discharging possible condensation, or print material that could be present inside them. Moreover, said tanks 25*a*, 25*b* can be provided with sensors detecting print material. If such sensors are activated, they control or provide a signal for deactivating said members 19, 20 for generating negative pressure. In this way damages to the members 19, 20 generating negative pressure can be prevented.

In an embodiment of the present invention, the recirculating unit 15 comprises a second recirculating sub-unit 17 too, to transfer the print material from the second container 18 to the first container 14.

The second recirculating subunit 17 comprises a pumping device 23 connected, through a pipe 28, to the first container 14 and second container 18, to shift the print material from the second container 18 to the first container 14. In a preferred embodiment, the suction pipe 28 is connected with one of its end to the lower portion, or bottom, of the second container 18. This allows preventing that air is suctioned through suction pipe 28.

The pipe 28 connects the pumping device 23 to print material second container 18, while a pipe 45 connects the pumping device 23 to the first container 14 for print material. In a preferred embodiment, the pipe 45 is connected with one of its end to the lower portion, or bottom, of the second container 18. This allows preventing that air is suctioned through suction pipe 28.

In an embodiment, at least the delivery pipe 45 is provided with a filtering device 59 for filtering the print material stream that from the second container 18 enters in the first container 14. Moreover, should the pumping device 23 membrane break, the presence of the filtering device 59 prevents the entrance of undesired particles into the print material first container 14, and from there to the print head 13, with ensuing possible damages to the print head.

According to an embodiment of the present invention, at least the delivery pipe 45 connecting the output of the pumping device 23 with the first container 14 of the recirculating unit 17, has an outlet which is placed at a depth inside the said first container 14 which depth is lower than a predetermined minimum ink level L1 inside the said first container 14.

In a further embodiment, also the pipe 28 connecting the second container 18 with the input of the pumping device 23 of the recirculating unit 17, has an inlet which is placed at a depth inside the said first container 14 which depth is lower than a predetermined minimum ink level L1 inside the said first container 14.

In an embodiment, there are provided detection devices, which comprise a first level sensor 56*a* to detect the level of print material in the first container 14, and a second level sensor 56*b* to detect the level of print material in the second container 18.

The first level sensor and the second level sensor can be chosen from a group comprising optical sensors, magnetic sensors, inductive sensors, capacitive sensors, floating members, or possible combinations thereof.

In the present embodiment, there are provided new dynamic level sensors, which allow, with respect to the previous on/off sensors, a more accurate control of print material level in the feed tank of the print heads, improving their management.

In an embodiment, the recirculating unit 15 comprises conditioning devices connected to at least one of either the first container 14 or the second container 18 and configured to modify in a desired way the physical characteristics (e.g. temperature, viscosity) of the print material that circulates through the print head 13.

The conditioning devices can comprise a system to regulate the temperature, for example obtained with a heat-carrying circuit, able to modulate the temperature of the print material contained in at least one of either the first container 14 or the second container 18, for example by heating and/or cooling action.

The conditioning devices comprise e.g. a heating member 52 mounted outside at least one of either the first container 14 or the second container 18 to heat the print material contained in the latter according to pre-set modes.

The heating member comprises e.g. an electric resistance 52 as shown in FIG. 1, a heat conditioning circuit or other device suitable to the purpose.

In a further embodiment, the conditioning devices comprise a cooling member 61 to induce in at least one of either the first container 14 or the second container 18 a cooling of the print material contained therein, and to adjust its temperature to the temperature of use by the print head 13. In an embodiment, the cooling member 61 comprises a fluid-dynamic conditioning circuit that exploits the principles of a cooling cycle.

The printing apparatus comprises a control unit 33, in this case a PLC, configured to monitor and manage at least the functioning mode of the first recirculating subunit 16 and the second recirculating subunit 17. In particular, depending on the signals detected by the first level sensor and the second level sensor, the control unit 33 can suitably manage the activation of the first pumping device 22 and of the pumping device 23, in order to maintain in the first container 14 and the second container 18 a predetermined level of print material, so as to ensure the correct supply to the print head 13.

In an embodiment, the control unit 33 is connected to the components of the apparatus 10 to be controlled and managed through electric connections (not shown), such as electric cables or electric tracks, in the case where the control device comprises integrated boards or PCB.

In a further embodiment, the control unit 33 can be served by user interface devices 34 to allow a human user to selectively set some print parameters and monitor alarms and anomalies.

In an embodiment, the interface devices 34 are external to the printing apparatus 10, for example made by means of an electronic calculator such as a PC, or similar device.

Even if the present invention was described with reference to a printing apparatus 10 comprising one print head 13 only, an application of the invention to a printing apparatus with more than one print head 13 is possible.

In an embodiment, for each print head 13 it is necessary to provide its own feed device 11 and its own recirculating unit 15, like in the description above In an alternative embodiment, the recirculating unit 15 according to the present invention can feed a plurality of print heads, typically up to four.

According to a variant embodiment of the apparatus of FIG. 1, the first and the second container 14 and 18 for the print material are provided with a dedicated print material level sensor 56*a* and 56*b*. Each of the two sensors monitors the level of the print material in the corresponding container 14 and 18 separately. The sensors react to a maximum print material L2 level in the respective container 14 and 18 and the signal generating by each sensor, separately, is transmitted to the control unit 33 which controls the members for generating negative pressure 19 and 20. When the level of the print material in at least one of the two containers 14, 18, reaches the maximum level L2, the signal of the sensor triggers the stop of the members generating negative pressure allowing the atmospheric pressure to build up into both the containers 14 and 18 and causing the print material to evacuate the containers. Evacuation takes place through the nozzles of the print head 13, since in absence of the flow through the print head no retain force is applied to the meniscus of print material in each of the nozzles and the print material flows down into a recovery tank 62.

From this tank, the print material can be again pumped into the system. This can be carried out automatically by providing sensors of the print material in the tank 62, such as level sensors or other kind of sensors which controls a pump for transferring the print material from tank 62 to the containers 14 and 18. Obviously the transfer of the print material from the retrieval tank 62 into the containers 14 and/or 18 can also be carried out by a manual control of the pump.

When the ink level in the containers reaches a minimum level indicated by L1 the level sensors 56*a* and/or 56*b* signals this condition and triggers the activation of the members 19, 20 generating the negative pressure in the containers 14 and 18 and the system starts again its normal operation.

The above system for controlling the level of the print material in the containers 14 and 18 is particularly relevant when considering that a negative pressure is applied to each of the containers 14 and 18 and since this negative pressures apply a suction action on the print material if the system fails in maintaining the correct balances of the pressures it easily may happen that the level of the print material in one of the two containers or in both rises in an uncontrolled manner leaving the container and filling up the apparatus. Monitoring the level of the print material allows directing the print material exciding a certain level along a controlled path to a retrieve tank avoiding the flow of rising print material flooding all-over the apparatus causing damages and requesting long lasting recovery interventions.

While the invention has been described in connection with the above described embodiments, it is not intended to limit the scope of the invention to the particular forms set forth, but on the contrary, it is intended to cover such alternatives, modifications, and equivalents as may be included within the scope of the invention. Further, the scope of the present invention fully encompasses other embodiments that may become obvious to those skilled in the art and the scope of the present invention is limited only by the appended claims.

LIST OF REFERENCE NUMBERS

10 printing apparatus
11 feed device
12 accumulation tank
13 print head
14 first print material container
15 recirculating unit
16 first recirculating sub-unit
17 second recirculating sub-unit
18 second print material container
19 member for generating negative pressure
20 member for generating negative pressure
21 filtering device
22 pumping device
23 pumping device
25*a* first overflow tank
25*b* second overflow tank
28 pipe
30 mixing device
33 control unit
34 interface device
41 pipe
42 pipe
142 pipe outlet
43*a* pipe
43*b* pipe
45 delivery pipe
46 pipe
47 pipe
50 pressure sensor
52 heating member
56 detection device
59 filtering device
61 cooling member
62 print material retrieve tank
L1 print material minimum level
L2 print material maximum level

The invention claimed is:

1. A printing apparatus comprising:

a print head adapted to print a print material;

a feed device to feed said print material to said print head; and a recirculating unit to generate a recirculation of said print material through said print head, said recirculating unit comprising:

(a) a first container of said print material placed upstream of said print head;

(b) a second container of said print material, placed downstream of said print head;

(c) a first recirculating sub-unit to generate a first flow of said print material from said first container to said print head and said second container; and (d) a second recirculating sub-unit to transfer said print material from said second container to said first container, wherein said first container and second container are both maintained under two distinct negative pressures, and wherein the feed device for refilling ink into the recirculation unit comprises a pipe feeding the ink to the first container of the recirculation unit and a pumping device for picking ink from an accumulation tank and feeding the ink to the first container, the pipe having an outlet opening which is placed at a predetermined depth inside the first container, said depth being lower than a predetermined minimum level of the ink inside the first container and/or inside the second container.

2. The printing apparatus according to claim 1, wherein said recirculating unit comprises two members generating negative pressures, connected to said first container and respectively to said second container.

3. The printing apparatus according to claim 2, further comprising in a negative pressure sensor, wherein said recirculating unit comprises protection members to prevent said print material contained in one or both of said first container or said second container from entering into said members generating negative pressure in the negative pressure sensor.

4. A printing method performed with the printing apparatus according to claim 1, comprising:

feeding, through the feed device, the print material to the print head for printing said print material, and recirculating, at least during printing, the print material through the print head, through the recirculating unit, by performing the following steps:

feeding said print material through said feed device to the first container of said recirculating unit, generating the first flow of said print material through the first recirculating sub-unit from said first container to said print head and to the second container of said recirculating unit, and transferring through the second recirculating sub-unit said print material from said second container to said first container, wherein said first container and second container of said print material are maintained under two distinct negative pressures, further comprising the steps of setting a predetermined minimum level of the print material in the first container and delivering the print material through the feed device inside the first container at a depth which is below the predetermined minimum level.

5. The printing method according to claim 4, wherein said first and said second print material containers are maintained under positive pressure for performing a cleaning cycle of said print head when said printing apparatus is not printing.

6. The printing method according to claim 4, wherein feeding the print material to the first container is carried out in a pulsed manner by feeding in an alternate manner predetermined amounts of the print material with a predetermined repetition cycles and with a predetermined duration of feeding and non-feeding.

7. The printing method according to claim 4, further comprising the steps of setting the predetermined minimum level of print material inside the first container and/or inside the second container, and delivering the print material recirculated by the second recirculating sub-unit in the first container at a depth which is lower than the predetermined minimum level inside the said first and/or the second container.

* * * * *